United States Patent [19]

Flanagan

[11] Patent Number: 4,521,999

[45] Date of Patent: Jun. 11, 1985

[54] INTERMENT ARRANGEMENTS FOR CREMATED REMAINS

[75] Inventor: Elaine W. Flanagan, Norwich, N.Y.

[73] Assignee: Starmax, Inc., Satellite Beach, Fla.

[21] Appl. No.: 371,262

[22] Filed: Apr. 23, 1982

[51] Int. Cl.[3] ..... E04H 13/00

[52] U.S. Cl. ..... 52/103; 52/134; 52/136

[58] Field of Search ..... 52/103, 104, 134, 136, 52/572, 602, 609, 610

[56] References Cited

U.S. PATENT DOCUMENTS

| | | | |
|---|---|---|---|
| 274,638 | 3/1883 | Mould | 52/103 |
| 617,161 | 1/1899 | Hunter | 52/134 X |
| 631,890 | 8/1899 | Hawthorne | 52/103 |
| 751,346 | 2/1904 | Schall | 52/602 |
| 963,572 | 7/1910 | Ifft | 52/104 X |
| 1,526,730 | 2/1925 | Zottoli | 52/602 X |
| 1,585,411 | 5/1926 | Patterson | 52/103 X |
| 2,009,724 | 7/1935 | Bircher | 27/1 |
| 2,038,962 | 4/1936 | Schulthess | 72/7.3 |
| 2,075,859 | 4/1937 | Martin | 40/124.5 |
| 2,120,082 | 6/1938 | Anderson | 52/103 |
| 2,513,951 | 7/1950 | McClellen | 27/1 |
| 3,167,844 | 2/1965 | Bachofner | 27/1 |
| 3,254,773 | 6/1966 | Diem | 211/71 |
| 3,287,865 | 11/1966 | Lockman | 52/136 |
| 3,455,072 | 7/1969 | Ferris, Jr. | 52/136 X |
| 3,529,730 | 9/1970 | Thompson | 211/71 |
| 3,726,052 | 4/1973 | Thompson | 52/103 |
| 3,754,805 | 8/1973 | Pangburn et al. | 52/136 X |
| 3,878,656 | 5/1975 | Duwe et al. | 52/136 X |
| 3,925,944 | 12/1975 | Pickel | 52/136 X |
| 3,945,094 | 3/1976 | Darán et al. | 52/134 X |
| 3,958,378 | 5/1975 | Omeechevarria | 52/136 |
| 3,990,198 | 11/1976 | Ortutay | 52/136 |

FOREIGN PATENT DOCUMENTS

| | | | |
|---|---|---|---|
| 2361922 | 6/1975 | Fed. Rep. of Germany | 52/136 |
| 620780 | 1/1927 | France | 52/572 |

*Primary Examiner*—Alfred C. Perham
*Attorney, Agent, or Firm*—Kenyon & Kenyon

[57] ABSTRACT

An above-ground interment arrangement for cremated remains which are contained in respective remains vessels. The arrangement is provided with a foundation which rests upon the ground of the cemetery, or other location. At least one further portion of the arrangement, which may be part of a pre-existing monument, is provided with a repository chamber adapted for receiving a remains vessel. In some embodiments, the portion of the arrangement which rests upon the foundation may be formed of several levels of repository chambers to form a stack which may accommodate a multiplicity of remains vessels. In further embodiments, two such stacks may be arranged side by side to double the capacity of the interment arrangement, and render it suitable for interring the victims of battles or catastrophes. Each such repository chamber is provided with a respective cover which may be affixed to the monument by any of several known means. A still further embodiment of the invention is disclosed for interring the remains of several deceased persons, in respective remains vessels, in a single large repository chamber.

25 Claims, 18 Drawing Figures

INTERMENT ARRANGEMENTS FOR CREMATED REMAINS

BACKGROUND OF THE INVENTION

This invention relates generally to interment arrangements, and more particularly, to an arrangement for interring cremated remains in an above-ground monument.

Throughout the world there is a growing trend away from the traditional burial disposition of the deceased, and toward the less expensive and voluminous practice of cremation. In England, for example, only 4% of those who died in 1945 were cremated. Today, however, this number has risen to 75%. In the United States, only 10% of those who die are cremated. However, the rate of cremation is accelerating, especially in view of the disappearance of many religious objections.

The primary reason for the increasing popularity of cremation is one of economics. Cremation occurs in a crematorium at a temperature of approximately 2300° F. What remains of the deceased after two hours of exposure to such an elevated temperature is but a calcium deposit which may be entirely contained in a vessel the size of a textbook. Such a vessel, of course, is substantially less expensive than a casket of the type used in a traditional funeral.

In addition to the reduced cost of hardware for the deceased, the practice of cremation results in further savings to the survivors by reducing the amount of real estate required by the deceased, and the maintenance thereof. Moreover, survivors who are required to move their residences frequently can easily and inexpensively bring the remains of deceased loved ones to the new location.

One known system for interring the ashes of cremated deceased persons utilizes a frame-like structure for holding a plurality of cremation urns. The frame is flexible as to size, shape and urn capacity, depending upon the manner in which it is assembled. Such a system, however, leaves the cremation urns exposed to the environment, and must be constructed so as to be arranged against a further structure, such as a wall. Thus, this known arrangement is not free-standing and is difficult to transport to new locations.

A further known receptacle for the ashes of a body after cremation is in the form of a columbarium in which horizontally disposed tube structures are arrayed in a contiguous side-by-side relationship. A plurality of receptacles containing the cremated remains are configured so as to conform to the interior cross-sectional shape of the tube structures, but slightly smaller. This permits the receptacles to be sequentially loaded axially into the tube structures for storage. The tube structures are held in a generally close adjacent side-by-side arrangement by horizontal and vertical frame members. Alternatively, the tube structures may have a cross-section which simulates a six-sided honeycomb. Although a high interment density is achieved with this arrangement, access to the remains of persons previously interred requires disturbance of the remains of the more recently interred.

Neither of the foregoing known interment arrangements provides the aesthetic appeal and security against cemetery vandalism which is achieved by using traditional monument materials. Accordingly, it is an object of the invention to provide an interment arrangement for cremated remains contained in respective remains vessels, the arrangement being formed of conventional cemetery monument materials.

It is a further object of this invention to provide an interment arrangement having an advantageously adjustable capacity.

It is another object of this invention to provide an above-ground interment arrangement wherein each remains vessel is accessible independently of other such vessels interred in the arrangement.

It is a still further object of this invention to provide an interment arrangement for cremated remains contained in individual remains vessels, the arrangement being constructed of a predetermined stone material with a minimum of waste.

It is yet another object of this invention to provide an interment arrangement for cremated remains, the arrangement having a plurality of repository chambers, each repository chamber having a respective cover which closes the associated repository chamber and through which access to the cremated remains is obtained.

A further object of the invention is to provide an above-ground interment arrangement which can be easily moved to a new location.

Another object of the invention is to provide an interment arrangement for the cremated remains of a multiplicity of deceased persons, each such remains having a respective repository chamber having an associated cover which can be inscribed to identify the deceased person whose remains lie therein.

It is yet a further object of the invention to provide an interment arrangement for cremated remains, which can be formed from an existing monument presently in place on a cemetery plot. Thus, when the cemetery plot is full and cannot accomodate a further conventional casket, the existing monument can be reconfigured in accordance with the invention to accomodate the cremated remains of a recently deceased person.

SUMMARY OF THE INVENTION

The foregoing and other objects are achieved by this invention which provides an above-ground interment arrangement for the cremated remains of a deceased person contained in a remains vessel, the vessel being disposed in a respository chamber of the interment arrangement. The interment arrangement contains at least one layer of monument material having a first surface on which is disposed a plurality of protruding members extending orthogonally therefrom by a predetermined height.

In one embodiment, the interment arrangement is provided with a foundation having an upper surface. The layer is arranged on the surface of the foundation so that the protruding portions of the layer contact the upper surface of the foundation. In this manner, the space between the protruding portions, in combination with the upper surface of the foundation, define a respository chamber.

The opening to the repository chamber may be provided with a recessed portion for engaging a cover. The recessed portion may be in the form of a rabbet cut which prevents the cover from falling inwardly into the repository chamber. The cover may be inscribed with information which identifies or otherwise relates to the deceased contained in the repository chamber.

In another embodiment of the invention, a plurality of layers of monument material having protruding members extending orthogonally from one side thereof are stacked upon one another so as to form at least two levels of repository chambers for accepting respective remains vessels. The layers are arranged so that their orthogonally protruding members extend downwardly, thereby utilizing a foundation slab to complete the lowest level of repository chambers. Alternatively, the layers are arranged so that their orthogonally protruding members extend upwardly; in which case the uppermost layer is provided with a slab in the form of a cover which thereby completes the topmost layer of repository chambers.

Each repository chamber may be provided with one, and perhaps two, covers which serve to seal respective open ends of the repository chambers. Alternatively, one or both such covers may be hingedly affixed to the monument so as to form a small door or flap which can be closed and locked by known locking mechanisms. The locking mechanisms may be selectably arranged in the cover, or in the monument.

In some embodiments, the orthogonally protruding members on each layer, which form the walls of the repository chambers, are cut integrally with the layers proper to form a unified layer structure. Such unified layer structures may be cut with the periodic protruding portions and the layer surfaces, which may be viewed as notches, having equal lengths along the longitudinal length of the layer, thereby permitting two such layers to be cut simultaneously in a mirror-image configuration whereby waste of monument material is minimized. Alternatively, the orthogonally protruding portions may be cut separately from the layers, the protruding portions being mechanically coupled to the layers by adhesives or fasteners.

In a still further embodiment of the invention, the interment arrangement may be in the form of an above-ground box formed of a plurality of vertical wall slabs with a cover slab thereon. This produces a large repository chamber which may contain a multiplicity of remains vessels. A door may be provided on one of the vertical wall slabs, or on the cover slab, to permit access to the repository chamber without requiring the cover slab to be raised or removed. Such a door may be secured by a lock, the key for which being retained by the family. In addition, the cover slab may be configured on its underside to structurally assist the wall slabs maintain proper orientation.

BRIEF DESCRIPTION OF THE DRAWINGS

Comprehension of the invention is facilitated by reading the following description in conjunction with the annexed drawings, in which.

DETAILED DESCRIPTION

Figure 1:
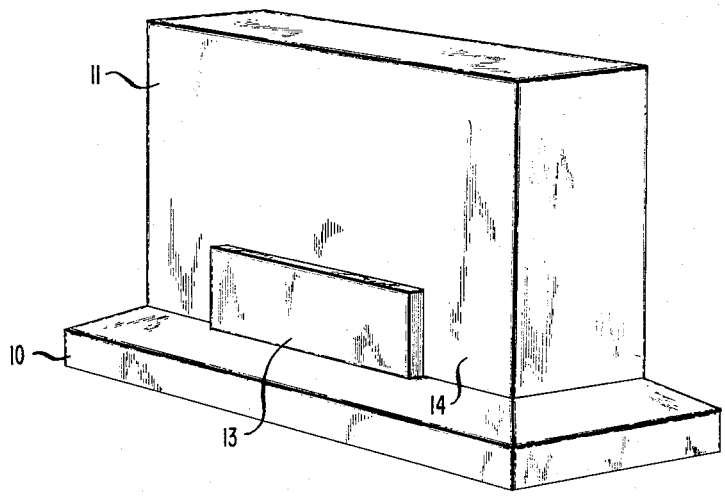
FIG. 1 is an above-ground monument constructed in accordance with the principles of this invention for the interment of the cremated remains of an individual, the monument having a cover which seals the respository chamber.

FIG. 1 shows an above-ground monument for the interment of cremated remains constructed in accordance with the principles of the invention. A foundation slab 10 which may be formed of any suitable material rests upon the ground in a cemetery, or any other location where interment is desired. The foundation slab may be provided on its underside with securing means (not shown) for affixing the foundation slab to the ground. A monument body 11, which, in this specific illustrative embodiment of the invention, is provided with a substantially rectangular overall shape, is arranged on foundation slab 10. Monument body 11 is provided with a notched opening (not shown in this figure) which is closed by a cover 13. The communication of monument body 11 with foundation slab 10 complete four sides of a repository chamber (not shown). Cover 13 is affixed to monument body 11 so as to be disposed on a lateral facia 14 thereof, in a manner which will be described hereinbelow, so as to seal the repository chamber. A further cover (not shown) may be provided to seal the repository chamber at a second lateral facia on the reverse side of the monument, which is not visible in this figure.

Figure 2:
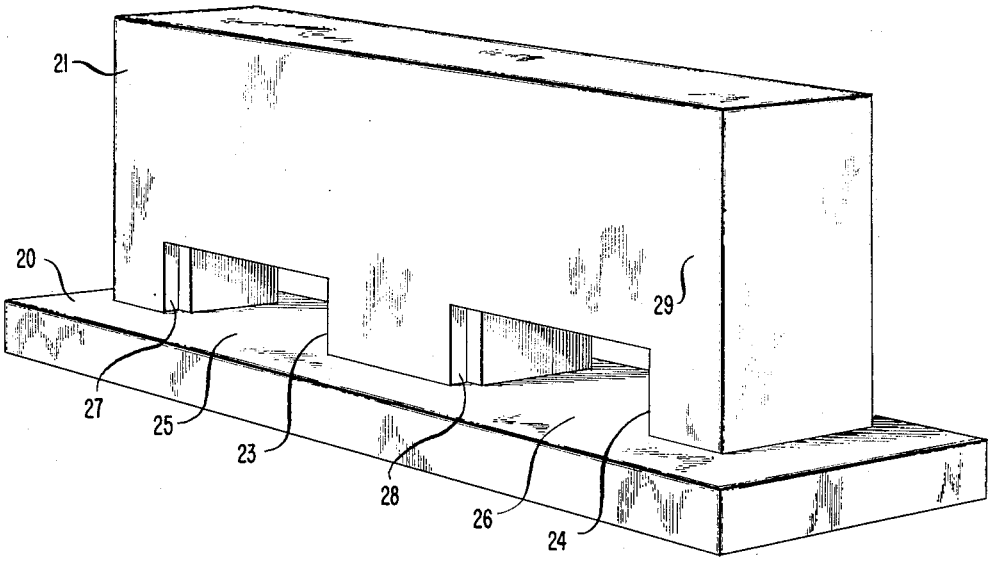
FIG. 2 is an above-ground monument for the interment of the cremated remains of two deceased persons.

FIG. 2 shows a further embodiment of the invention having a foundation slab 20 and a monument body 21 mounted thereon. In this embodiment, monument body 21 is provided with two notched portions 23 and 24 which, when foundation slab 20 and monument body 21 are in communication with one another, form respective repository chambers 25 and 26. Each of the notched portions 23 and 24 is provided with a rabbeted portion 27 and 28, respectively, for facilitating engagement with sealing covers (not shown), which may be similar to cover 13 shown in FIG. 1. Rabbeted portions 27 and 28 extend for the entire perimeter of notched portions 23 and 24, and are visible as extending inwardly through a lateral facia 29 of monument body 21.

The various portions of the embodiments of FIGS. 1 and 2 may be assembled with the use of an adhesive material. One such material is a commercially available putty-like material which hardens and produces a suction between the mated surfaces of the monument. Such a suction-producing material may also be used to secure the covers to the monuments. Alternatively, an epoxy material may be used to form a strong adhesive bond. Either type of material may be used in conjunction with other types of adhesives, or fasteners, as will be explained more fully hereinbelow.

It should be noted that the embodiments of the invention described hereinabove with respect to FIGS. 1 and 2, and other embodiments which are described below, can be formed directly from pre-existing monuments. This is a particularly advantageous feature of the invention which permits interment of the cremated remains of a deceased person within the above-ground monument in situations where the cemetery plot is full, and therefore incapable of accomodating further conventional interments. Moreover, the use of the pre-owned monument material to produce the above-ground interment arrangement reduces substantially the cost of the interment to the survivors.

Figure 3:
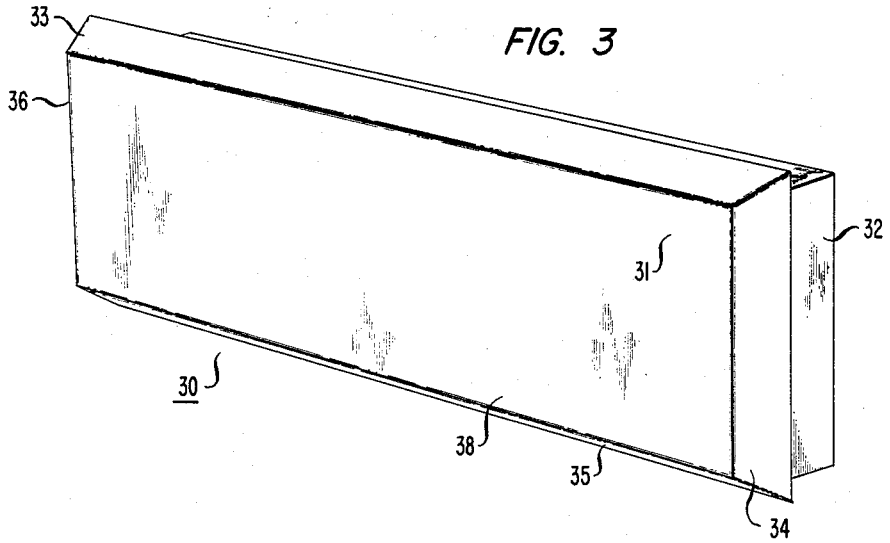
FIGS. 3, 4 and 5 are isometric and lateral plan views of covers which may be used to seal the repository chambers in the above-ground monuments.
Figure 4:
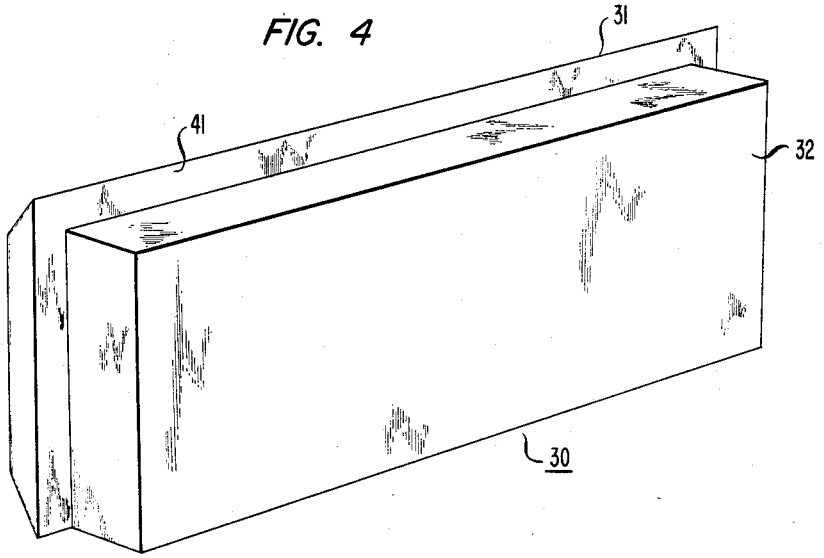
Figure 5:
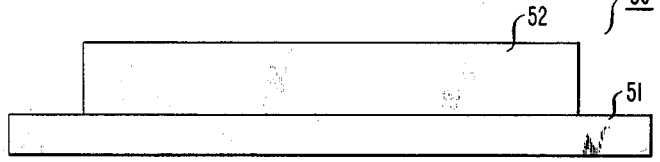

FIGS. 3, 4 and 5 are perspective and the lateral plan representations of sealing covers which are suitable for use in the embodiments of FIGS. 1 and 2. FIG. 3 shows an outside perspective view of a cover 30 which is formed of an outer portion 31 and an inner portion 32. As shown in FIG. 3, outer portion 31, in this embodiment of the cover, is shaped so that walls 33, 34, 35 and 36, which correspond to the thickness of outer portion 31, are canted inwardly toward one another. Outermost surface 38 is suitable for inscribing.

FIG. 4 shows a perspective view of cover 30 from the inner side. As shown, inner portion 32 is substantially rectangular in configuration, and dimensioned to be smaller than outer portion 31, thereby producing a lip 41 on three inneredges of outer portion 31, in this embodiment. In addition, inner portion 32 is dimensioned to fit within a respective one of rabbeted portions 27 and 28 of FIG. 2. Lip 41 rests on the outermost surface of monument body 21, while the lowest edge of the cover, which is not provided with a lip, rests on foundation slab 20. Of course, in embodiments of the invention wherein rabbeted portions are provided, a lip, such as lip 41, need not be provided on the cover. Conversely, in embodiments where a lip 41 is provided, the monument body need not be provided with rabbeted portions because the lip will serve to keep the cover in position at the opening of the repository chamber.

FIG. 5 is a lateral plan view of a cover 50 having outer and inner portions 51 and 52, respectively. In this embodiment, outer portion 51 has a substantially rectangular configuration, and is, therefore, similar to cover 13 shown in FIG. 1. Although other configurations for the edges of outer portions 51 may be provided, such configurations should preferably minimize the possibility of unauthorized and forced removal of the cover by cemetery vandals.

In some embodiments, the covers may be temporarily secured to the openings of repository chambers which are not yet occupied, by putty which permits relatively easy removal of each cover to facilitate future interments. Once an interment has occured, the cover may be epoxied in position so as to form a more permanent seal. Alternatively, known locking mechanisms (not shown) may be incorporated in the covers to permit access to the contents of the repository chamber, as desired. In yet further embodiments, the covers may be hinged along one edge to the monument so as to form a door or flap which may be opened at will be means of known locking mechanisms. Such hinged affixation of the cover to the monument provides the further advantage of avoiding loss of the cover.

Figure 6:
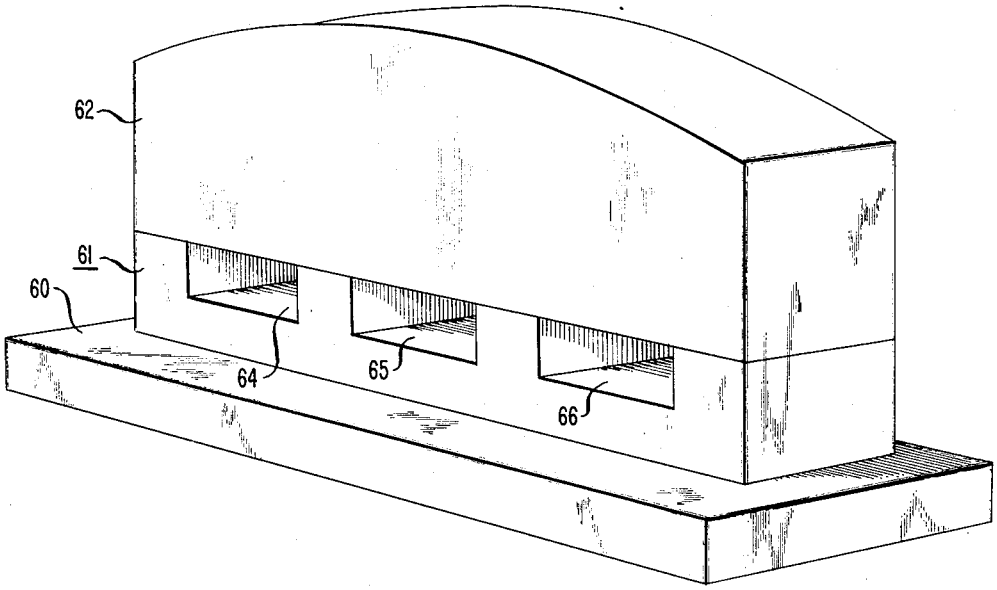
FIG. 6 is an isometric view of an above-ground monument constructed of three sections which are mechanically affixed to one another.

FIG. 6 shows an above-ground monument for the interment of the cremated remains of between three and six deceased persons. This embodiment of the invention is formed of three portions: a foundation slab 60, a central notched portion 61 and a monument cover portion 62. Repository chambers 64, 65 and 66 are formed upon the joining of central notched portion 61 and monument cover portion 62.

Figure 7:
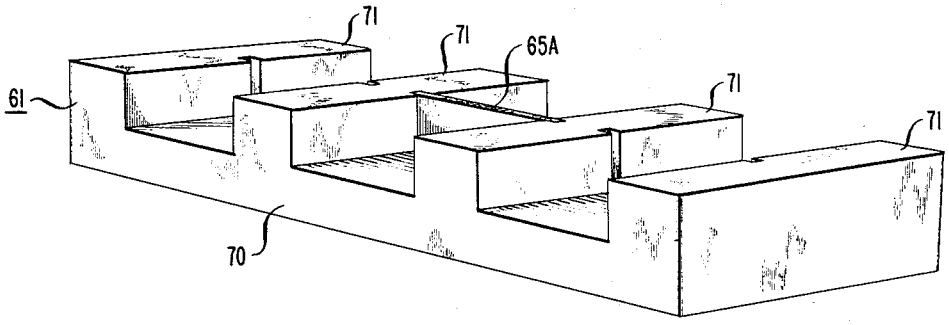
FIG. 7 is an isometric view of the central notched portion of the embodiment of FIG. 6 showing protruding wall portions formed integrally with a floor layer portion.

FIG. 7 shows a perspective view of central notched portion 61 which may be viewed as being formed of a floor layer portion 70 which forms the floors of repository chambers 64, 65 and 66, and a plurality of integrally-formed wall portions 71 which protrude transversely from the major plane of floor layer portion 70 to form the walls of the repository chambers. As shown in FIG. 6, the ceilings of the repository chambers (not shown) are formed by the lowermost surface of monument cover portion 62. As previously noted, a central portion such as central notched portion 61 may be inserted into an existing monument to enlarge the interment capacity of the cemetery plot. In cases where the monument is sufficiently wide to permit double interments in each repository chamber a separator such as separator 65A may be provided to double the capacity of the arrangement and afford privacy to the deceased during future interments. The separator may be formed of metal, or other suitable material.

Figure 8:
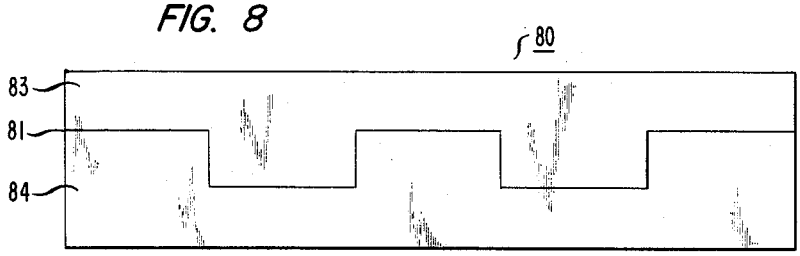
FIGS. 8 and 9 illustrate a method according to the invention for producing and combining sections of central notched portions for monuments, without wasting monument material.
Figure 9:
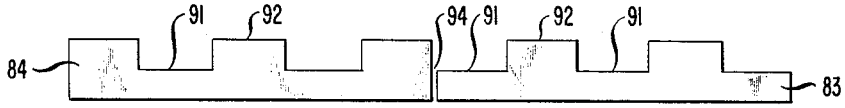

FIG. 8 shows the manner in which a block of monument material 80 may be cut along a cutting line 81 to form two notched floor layer portions, 83 and 84. In this manner, almost all waste of the material of block 80 is avoided. After the cutting is completed, notched portions 83 and 84 are disengaged from one another and may be arranged as shown in FIG. 9. In this embodiment, notches 91 and integrally formed protruding wall portions 92 all have equal lengths in the direction of the cutting line. A suitable filler material, such as epoxy, may be used to fill in gap 94 at the location where notched portions 84 and 83 meet one another. Of course, any number of notches and protruding wall portions may be cut from a block of monument material of suitable length, and several such notched portions may be placed end-to-end, in the manner shown in FIG. 9.

Figure 10:
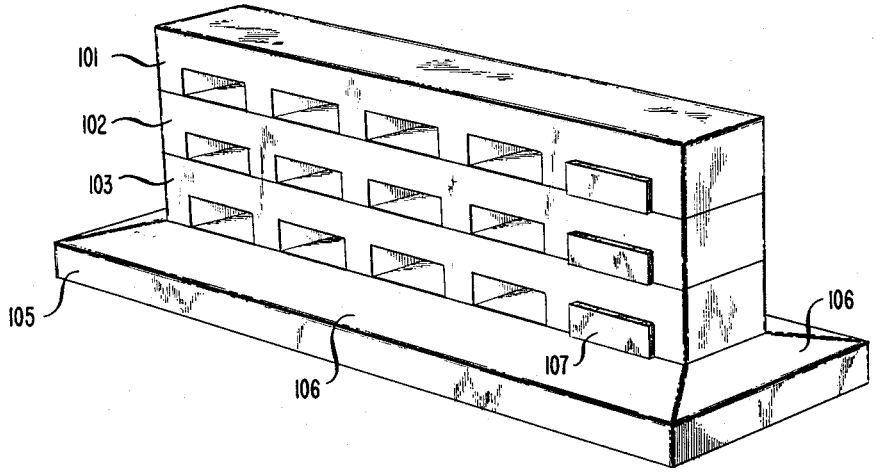
FIG. 10 shows an above-ground monument constructed in accordance with the invention for the interment of the cremated remains of fifteen to thirty persons.

FIG. 10 shows an above-ground monument for the interment of the cremated remains of between fifteen and thirty persons. In this specific illustrative embodiment, three notched sections 101, 102 and 103 are stacked upon one another with the protruding wall portions facing downward. The notched sections are arranged on a foundation slab 105, which, in this embodiment, is provided with chamfered surfaces 106. The notched sections are mechanically coupled to one another, and to the foundation slab by fasteners, adhesive, or any of the other known means described hereinabove. Some of the chambers are shown closed by covers 107.

Figure 11:
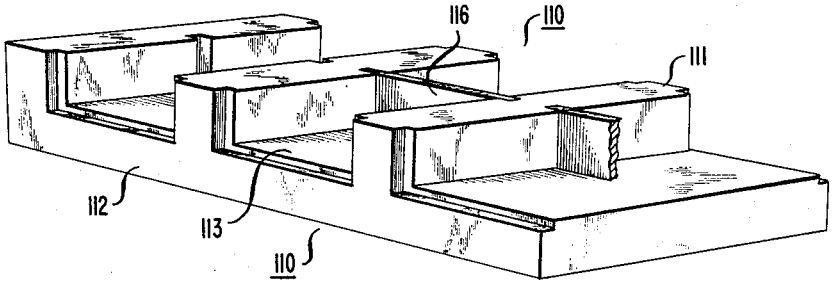
FIGS. 11 and 12 illustrate notched sub-sections which may be combined and layered to produce the above-ground monument of FIG. 10.
Figure 12:
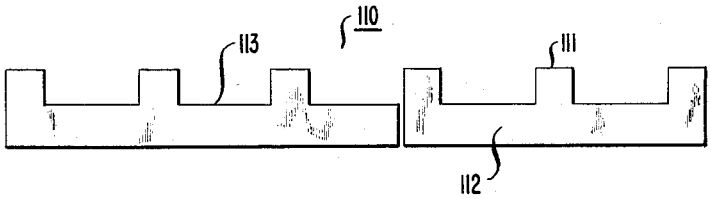

FIG. 11 shows a sub-section 110 of a notched section which may be used in the embodiment of FIG. 10. As shown, protruding wall portions 111 are integrally formed with layer portions 112, but have shorter longitudinal length than notches 113. Several such sub-sections may be joined end-to-end as shown in FIG. 12. Alternatively, the embodiment of FIG. 10 may be constructed of notched sections formed in accordance with the embodiment of FIGS. 8 and 9, and may be provided with a separator 116 along notches 113 as discussed hereinabove with respect to separator 65A of FIG. 7. Moreover, the edges may be rabbetted to accomodate covers.

Figure 13:
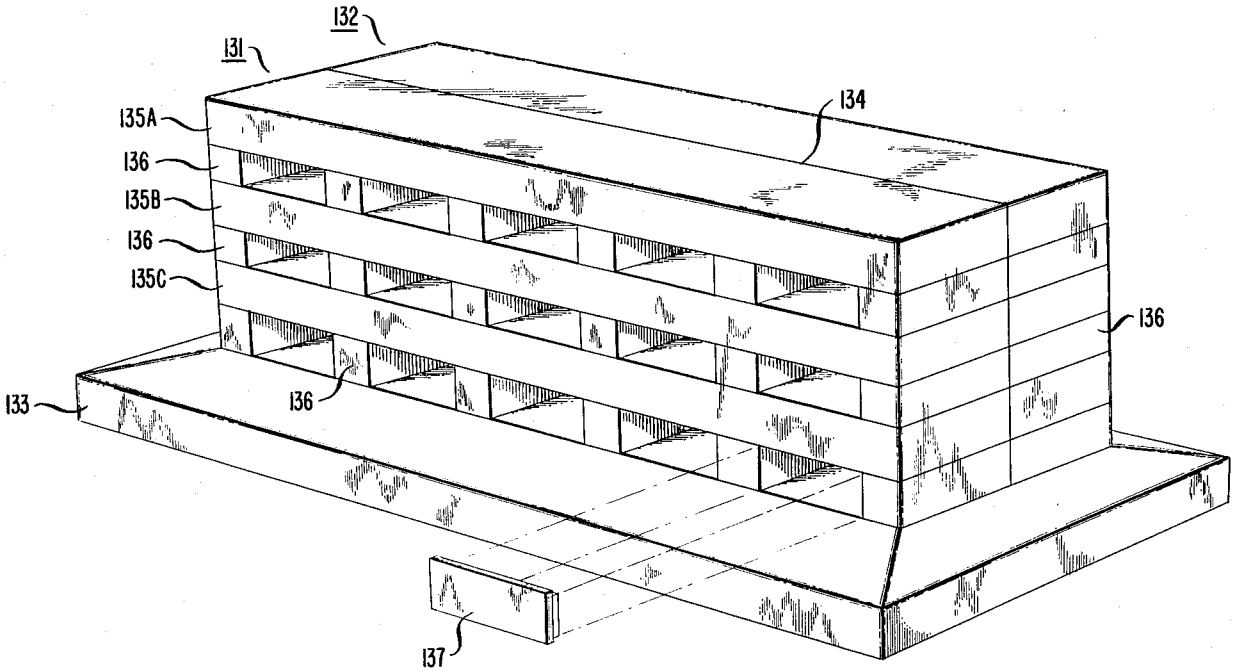
FIG. 13 shows an above-ground monument wherein the cremated remains of thirty persons may be interred, the monument being formed of individual layered and protruding wall portions for producing repository chambers.

FIG. 13 shows an embodiment of the invention having an interment capacity of up to thirty deceased persons. In this embodiment, a doubling of the interment capacity is achieved essentially by placing two stacks of single-depth notched sections in a side-by-side arrangement. Thus, two stacks of notched sections 131 and 132 are arranged on a foundation slab 133. In situations where it is desired to prevent access to a repository chamber by means of its adjacent repository chamber, a partition may be inserted between stacks 131 and 132 prior to their being joined along joint 134. Such a partition, of course, should not extend above the level of the top of the monument. It should, however, extend downwardly to the foundation slab.

In addition to the foregoing, the embodiment of FIG. 13 is different from those previously described in that the wall portions are formed of separate sections of monument material, and are therefore not integrally formed with the layer sections. Stack 131, for example, is formed of layer slabs 135A, 135B, and 135C which are arranged horizontally above one another, with wall portions 136 interposed therebetween. One manner in which this arrangement may be constructed is shown below in FIG. 14. In such an embodiment, or in embodiments where notched sections are used with their wall portions extending upwardly, each of stacks 131 and 132 may be provided with a separate lid slab. Alternatively, the stacks may share a large single lid which forms the top of the entire monument. Of course, each repository chamber may be provided with a cover, such as 137.

Figure 14:
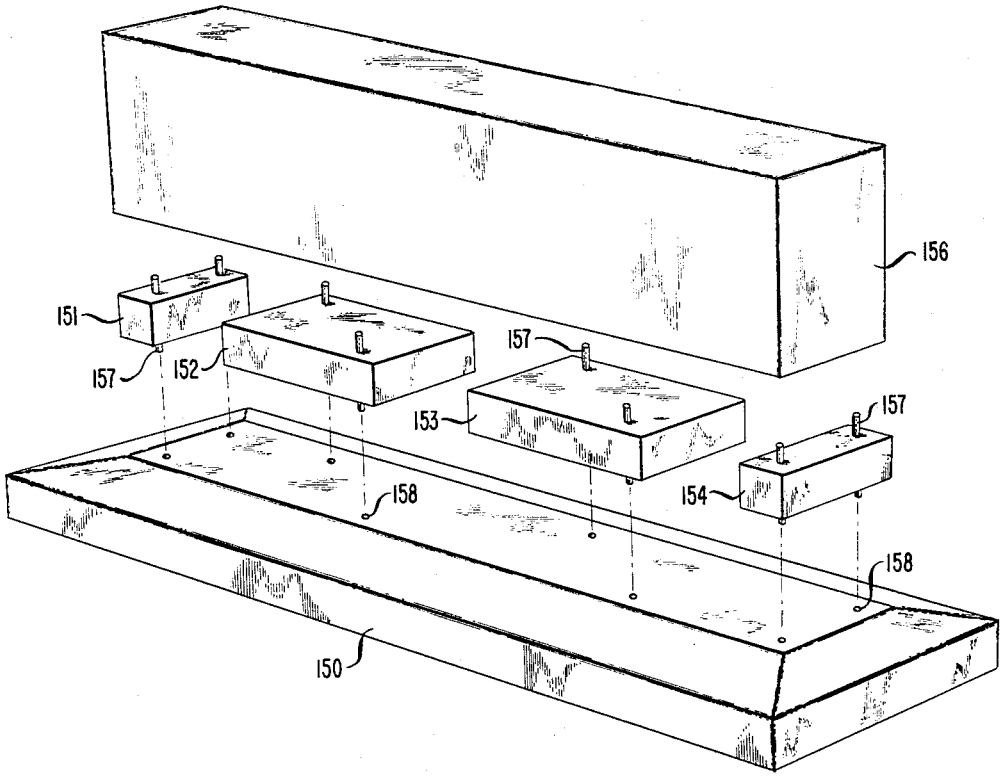
FIG. 14 shows an above-ground monument arrangement wherein the protruding wall portions are formed individually and mechanically fastened to lower and superior portions.

FIG. 14 shows an alternative manner for constructing an above-ground interment arrangement, in accordance with the invention. In this embodiment, a plurality of wall portions, 151, 152, 153 and 154, are interposed between a foundation slab 150 and a monument cover portion 156. The respective elements of the arrangement are mechanically coupled to one another by fasteners 157 which engage in corresponding holes 158. Similarly matching holes are provided on the underside (not shown) of monument cover portion 156. The system shown in this embodiment may be used to convert existing monuments into above-ground interment arrangements.

Figure 15:
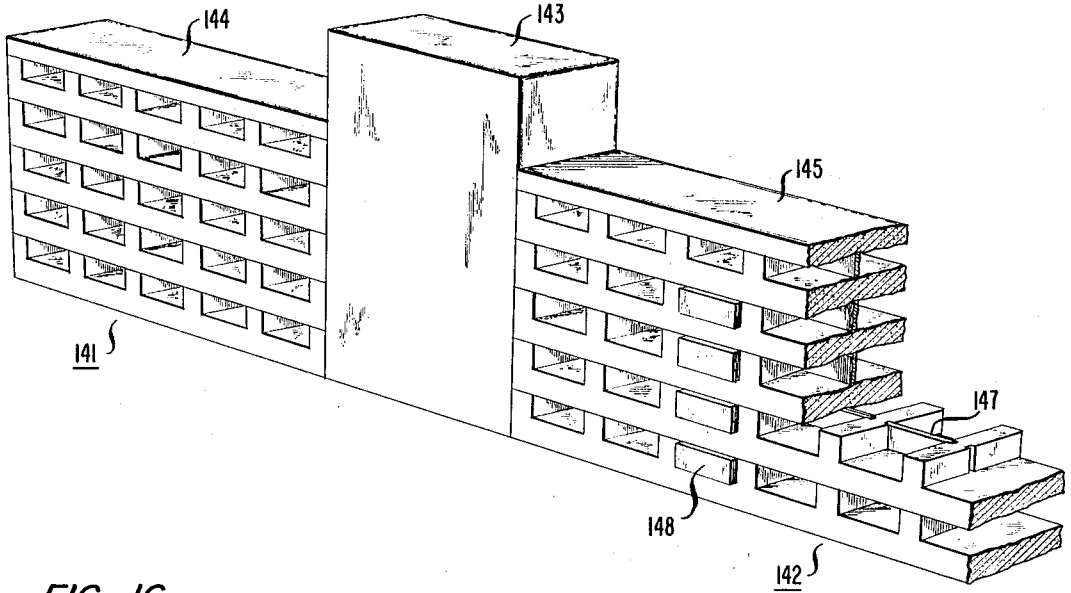
FIG. 15 shows an above-ground monument arrangement for the interment of the cremated remains of fifty persons, the monument having a central portion suitable for inscribing.

FIG. 15 shows an embodiment of the invention wherein a pair of notched section stacks 141 and 142, are arranged on either side of a decorative monument portion 143. Decorative monument portion 143 is provided with surfaces suitable for displaying an inscription. Such an arrangement is of advantageously adaptable capacity for the interment of the many casualties of a battle or catastrophe. The names of the interred individuals may be provided on the covers of the respective repository chambers, and the history of the event which caused their deaths may be inscribed on the surfaces of portion 143. In this embodiment, stacks 141 and 142 are arranged with the protruding wall portions of the individual notched sections extending upward, the stacks therefore being provided with cover slabs 144 and 145, respectively.

In the embodiment of FIG. 15, stacks 141 and 142 may be as long as necessary to accomodate all of the victims of the disaster. Moreover, each such stack may be of the abovedescribed double width configuration to allow interments from both sides of the monument. Each repository chamber in the double width embodiment may be provided with a separator 147 for preventing each of the remains from being disturbed upon the interment or removal of remains in the adjoining repository. Also, each chamber is provided with a cover, such as cover 148.

Figure 16:
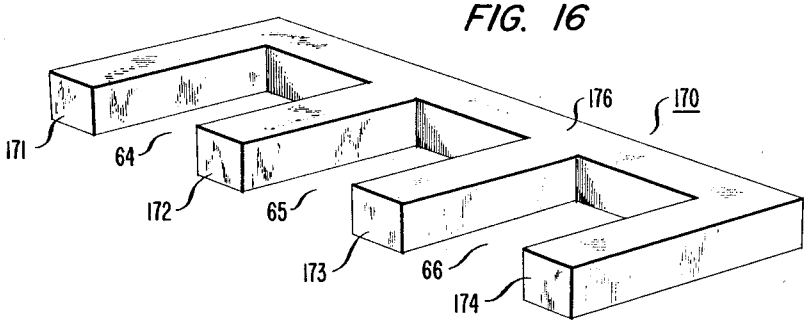
FIG. 16 is a perspective view of a central notched portion which reduces the amount of required monument material by having its wall portions extend horizontally rather than vertically.

FIG. 16 is a perspective view of a central notched portion 170 which is arranged to lay on its side with wall portions 171–174 extending horizontally. In use, a central notched portion similiar to that of FIG. 16 may be used in the embodiments of FIGS. 6, 13, and 14 in lieu of the central notched portions shown therein. For example, with respect to FIG. 6, central notched portion 61 may be replaced by central notched portion 170 of FIG. 16, in single-width embodiments of the invention where access to the interior of the repository chambers is had from only one side of the monument.

The inclusion of notched portion 170 in the embodiment of FIG. 6 would produce three repository chambers 64, 65, and 66, separated from one another by wall portions 172 and 173. The lower lateral surface of notched portion 170 would rest upon, and be affixed to, foundation slab 60. Monument cover 60 would be disposed on upper lateral surface 176 of notched portion 170. Of course, any number of wall portions and repository chambers can be configured, as desired.

The notched portion of FIG. 16 advantageously reduces the required amount of monument material because the thickness of the notched portion need be only as thick as the height of the repository chambers. This is considerably less than the overall thickness of monument material required in the abovedescribed central notched portions in FIGS. 7, 8, 9, 11, and 12. In addition, the savings in monument material may be further enhanced by cutting the notched portion with equaly dimensioned wall portions and repository chamber widths, as described with respect to FIGS. 8 and 9.

Figure 17:
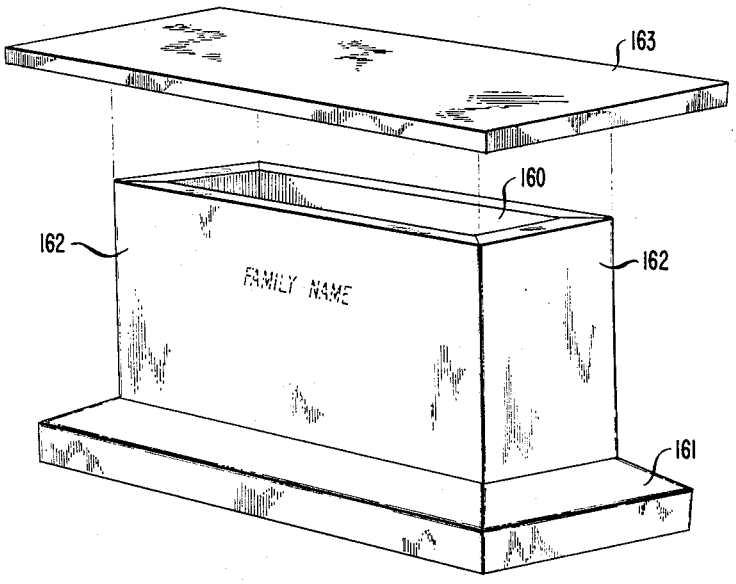
FIGS. 17 and 18 are perspective views of further embodiments of above-ground interment monuments.
Figure 18:
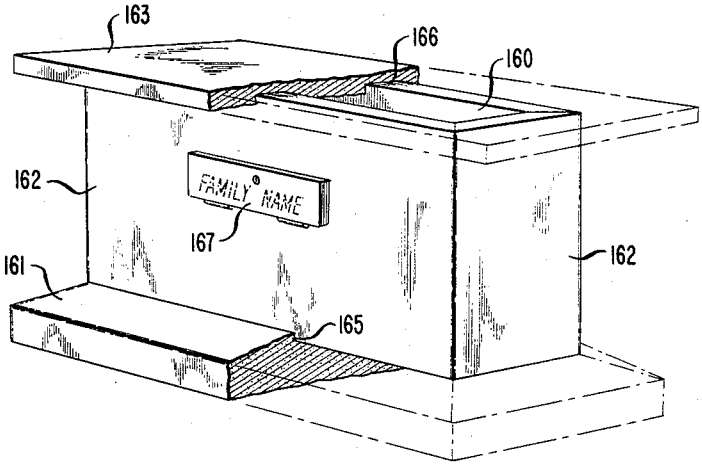

FIGS. 17 and 18 show a further embodiment of the invention wherein an above-ground monument is formed to provide a single, relatively large repository chamber 160 in which a plurality of vessels containing cremated remains may be interred. In this embodiment, a foundation slab 161 supports four repository walls 162. A cover 163 seals the repository chamber.

FIG. 18 shows foundation slab 161 and cover 163 partially fragmented so as to illustrate the manner in which they cooperate to hold walls 162 in proper orientation with respect to one another. As shown in the figure, cover 163 and foundation 161 are provided with indentations 166 and 165, respectively, for engaging the edges of walls 162. Cover 163 or walls 162 may be appropriately inscribed.

In a further embodiment of the invention, the above-ground monument of FIGS. 17 and 18 may be provided with an access door 167 in one or more of the walls 162. Such a door would eliminate the need for removing cover 163 when access to the monument contents are required. Alternatively, cover 163 may be provided with an opening (not shown) which is provided with a removable cover (not shown) for obtaining access to the interior of the monument. Such access devices would permit cover 163 to be permanently affixed to walls 162, thereby serving as a structural member for holding the walls in place.

Although the invention has been described in terms of specific embodiments for specific applications, it is to be understood that persons skilled in the art can generate additional embodiments, in light of this teaching, without departing from the spirit and scope of the invention. Accordingly, the drawings and descriptions in this disclosure are proffered to illustrate the principles of the invention, and should not be construed to limit the scope thereof.

What is claimed is:

1. An above-ground interment arrangement for cremated remains contained in remains vessels, the arrangement having a plurality of repository chambers adapted for receiving the remains vessels, the arrangement comprising:

foundation means having an upper surface for supporting the remains vessels, a portion of said upper surface forming a lowermost internal surface of the repository chambers; and monument body means cut integrally from a unitary block, said monument body means having a base surface plane and a first lateral facia, said base surface plane having a plurality of inwardly notched portions so as to be open with respect to said base surface plane and said first lateral facia, said notched portions forming an uppermost internal surface of the repository chambers, said monument body means being arranged on said foundation means with said flat surface of said foundation means in contact with said base surface of said monument body means, said notched portions of said monument body means and said upper surface of said foundation means defining the repository chambers, access to the repository chambers being had through said openings in said first lateral facia.

2. The interment arrangement of claim 1 wherein there is further provided cover means for closing said openings in said first lateral facia, said cover means having a predetermined thickness and being arranged substantially parallel with said first lateral facia.

3. The interment arrangement of claim 2 wherein said monument body means is provided with a recess for engaging said cover means, said recess being arranged inwardly with respect to said first lateral facia near said openings in said first lateral facia, said recess having an inward depth which corresponds to said predetermined thickness of said cover means.

4. The interment arrangement of claim 1 herein said monument body means is provided with a second lateral facia substantially parallel with said first laterial facia, said second lateral facia being open with respect to said inwardly notched portions, there being further provided rear covers for closing said openings in said second lateral facia.

5. The interment arrangement of claim 1 wherein said cut from a unitary block is formed in a periodic rectangular pattern such that after said cut is performed, two monument body means of equal amplitude are meshedly engaged with one another.

6. An above-ground interment arrangement for cremated remains contained in remains vessels, the arrangement having a plurality of repository chambers adapted for receiving said remains vessels, the arrangement comprising:

foundation means having an upper surface for supporting the remains vessels, a portion of said upper surface forming a lowermost internal surface of the repository chambers; and monument body means cut integrally from a unitary block, said monument body means having a base surface plane and first and second lateral facias on opposing sides of said monument body means, said base surface plane containing inwardly notched portions so as to be open with respect to said base surface plane and said first and second lateral facias, said notched portions forming an uppermost internal surface of the repository chambers, said monument body means being arranged on said foundation means with said flat upper surface of said foundation means in contact with said base surface plane of said monument body means, said notched portions of said monument body means and said upper surface of said foundation means defining the repository chambers, access to the repository chambers being had through said openings in said first and second lateral facias.

7. The interment arrangement of claim 6 wherein there are further provided first and second cover means for closing said openings in said first and second lateral facias, respectively, each of said first and second cover means having a predetermined thickness and arranged substantially parallel with its associated one of said first and second lateral facias.

8. The interment arrangement of claim 7 wherein said monument body means is provided with recesses for engaging said first and second cover means, said recesses being arranged inwardly with respect to said first and second lateral facias, said recesses having depths corresponding to said predetermined thickness of said first and second cover means.

9. The interment arrangement of claim 6 wherein the repository chamber is provided with a partition therein for producing first and second remains compartments, each of said first and second remains compartments being accessible through a respective one of said openings in said first and second lateral facias.

10. The interment arrangement of claim 6 wherein said cut from a unitary block is formed in a periodic rectangular pattern such that after said cut is performed, two monument body means of equal amplitude are meshedly engaged with one another.

11. An above-ground interment arrangement for cremated remains contained in remains vessels, the arrangement comprising:

first monument layer means having predetermined length, width and height, said first monument layer means further having a first surface having a length and width which correspond to said predetermined length and width of said first monument layer means; and a plurality of protruding wall portions disposed on said first surface of said first monument layer means, each of said protruding wall portions having a predetermined protrusion height above said first surface of said first monument layer means, said monument layer means and said protruding wall portions being cut integrally from a unitary block, said cut being formed in a periodic pattern, such that after said cut is performed, said first monument layer means and said protruding wall portions are meshedly engaged with one another, the amplitude of said periodic pattern corresponding to said predetermined protrusion height.

12. The interment arrangement of claim 11 wherein said first monument layer means is further provided with a second surface parallel to said first surface, said second surface having a length and a width which correspond to said predetermined length and width of said first monument layer means, the interment arrangement further comprising second monument layer means having predetermined length, width, and height, said second monument layer means further having a first surface having a length and a width which correspond to said predetermined length and width of said second monument layer means, said second monument layer means being coupled to said first monument layer means so that said first surface of said second monument layer means is adjacent to said plurality of protruding wall portions on said first surface of said first monument layer means, so as to define between said protruding portions the repository chambers.

13. The interment arrangement of claim 12 wherein said second monument layer means is provided with a second surface parallel to said first surface, the arrangement further having a plurality of protruding wall portions disposed on said second surface of said second monument layer means, each of said protruding wall portions having a predetermined protrusion height above said second surface and said second monument layer means, said second monument layer means and said protruding wall portions being cut integrally from a unitary block, said cut being formed in a periodic pattern, such that after said cut is performed, said second monument layer means and said protruding wall portions are meshedly engaged with one another, the amplitude of said periodic pattern corresponding to said predetermined protrusion height.

14. The interment arrangement of claim 13 wherein there are further provided a plurality of cover means for closing respective ones of a plurality of repository chambers, said repository chambers being arranged between said protruding wall portions.

15. The interment arrangement of claim 14 wherein said first and second monument layer means are provided with recesses for engaging said plurality of cover means.

16. The interment arrangement of claim 11 wherein said periodic cut in said unitary block is formed in a rectangular pattern.

17. The interment arrangement of claim 12 wherein said second monument layer means is formed of a pre-existing cemetary monument.

18. An above-ground interment arrangement for cremated remains contained in remains vessels, the arrangement comprising a monument layer cut from a unitary block in a periodic rectangular pattern, said monument layer having a first surface with a plurality of protruding portions extending from said first surface, said monument layer further having a second surface arranged distal to said first surface.

19. The interment arrangement of claim 18 wherein there is further provided a monument foundation for holding said monument layer, said monument foundation having a support surface, said protruding portions of said monument layer being in contact with said support surface of said monument foundation to produce a plurality of repository chambers for containing the remains vessels.

20. The interment arrangement of claim 18 further comprising:

further protruding portions extending from said second surface of said monument layer; and a monument cap arranged on said further protruding portions extending from said second surface of said monument layer.

21. The interment arrangement of claim 20 wherein said monument cap is formed of a pre-existing cemetary monument.

22. An above-ground interment arrangement for interring cremated remains in a plurality of respository chambers, the arrangement comprising:

foundation means having an upper horizontal surface for supporting the arrangement, a portion of said upper horizontal surface forming a lowermost internal surface of the repository chambers;

an intermediate portion integrally cut from a unitary block, said intermediate portion for defining the walls of a plurality of repository chambers, said intermediate portion being formed of at least a repository chamber rear wall section and a plurality of repository chamber side wall sections, said side wall sections being arranged substantially horizontally orthogonal to said rear wall section; and a cover portion having a lower horizontal surface for covering the arrangement, a portion of said lower horizontal surface forming an uppermost internal surface of the repository chambers.

23. The interment arrangement of claim 22 wherein there is further provided cover means for defining a fourth wall of the repository chambers.

24. The interment arrangement of claim 22 wherein said cover portion is formed of a pre-existing cemetery monument.

25. The interment arrangement of claim 22 wherein said cover portion is formed of a pre-existing cemetary monument.

* * * * *